United States Patent [19]

Black

[11] 4,170,013

[45] Oct. 2, 1979

[54] STRIPLINE PATCH ANTENNA

[75] Inventor: Lawrence M. Black, Olney, Md.

[73] Assignee: The United States of America as represented by the Secretary of the Navy, Washington, D.C.

[21] Appl. No.: 929,060

[22] Filed: Jul. 28, 1978

[51] Int. Cl.[2] ..... H01Q 1/38

[52] U.S. Cl. ..... 343/700 MS; 343/846

[58] Field of Search ..... 333/84 M, 84 R; 343/700 MS, 708, 767, 769, 795, 846, 854

[56] References Cited

U.S. PATENT DOCUMENTS

| | | | |
|---|---|---|---|
| 2,285,676 | 5/1959 | Baldwin | 343/708 |
| 3,665,480 | 5/1972 | Fassett | 343/854 |
| 3,971,125 | 7/1976 | Thies, Jr. | 343/854 |
| 4,017,864 | 4/1977 | Procter | 343/767 |
| 4,021,813 | 5/1977 | Black et al. | 343/854 |
| 4,040,060 | 8/1977 | Kaloi | 343/700 MS |

*Primary Examiner*—David K. Moore

*Attorney, Agent, or Firm*—R. S. Sciascia; A. L. Branning; R. E. Bushnell

[57] ABSTRACT

A conformal antenna having a microstrip patch centered below a slot in a groundplane and covered by a dielectric window and coupled to a stripline feed.

14 Claims, 3 Drawing Figures

STRIPLINE PATCH ANTENNA

BACKGROUND OF THE INVENTION

The present invention relates generally to antennae and more particularly, to stripline and microstrip antennae.

Two types of antennae are presently in use in conformal arrays: the stripline slot and the microstrip patch. The stripline slot antenna is inherently unstable in those applications where exposure to environmental stresses such as diurnal variations in the ambient temperature cause changes in the dimensions of the slot or cavity. The microstrip patch antenna has unshielded feed lines that tend to radiate and couple with other feed lines and radiators mounted on the same circuit board, unpredictably influencing radiation patterns and impedance characteristics.

The noun "stripline," as used here, is a contraction of the phrase "strip type transmission line", a transmission line formed by a conductor above or between extended conducting surfaces. A shielded strip-type transmission line denotes generally, a strip conductor between two ground planes. The noun "groundplane" denotes a conducting or reflecting plane functioning to image a radiating structure.

SUMMARY OF THE INVENTION

A hybrid stripline-microstrip microwave antenna with a radio-frequency source coupled to an external connector. A stripline coupled to the connector lies sandwiched between a pair of parallel dielectric layers clad with exposed groundplanes and feeds a microstrip patch radiator. A dielectric window fills a cavity in one groundplane adjoining the patch, and covers the patch.

It is an object of the present invention to provide an antenna that is free from variations in performance due to environmental stresses.

It is a second object to provide an antenna free of unpredictable variations in its radiation pattern.

It is another object to provide an antenna free of variations in its impedance characteristics.

It is yet another object to provide an antenna suitable for use in a conformal array.

It is still another object to provide a lightweight, easily made, radio frequency antenna element.

BRIEF DESCRIPTION OF THE DRAWINGS

A more complete appreciation of this invention, and many of the attendant advantages thereof, will be readily enjoyed as the same becomes better understood by reference to the following detailed description when considered in conjunction with the accompanying drawings in which like numbers indicate the same or similar components, wherein.

DETAILED DESCRIPTION OF THE PREFERRED EMBODIMENT

Figure 1:
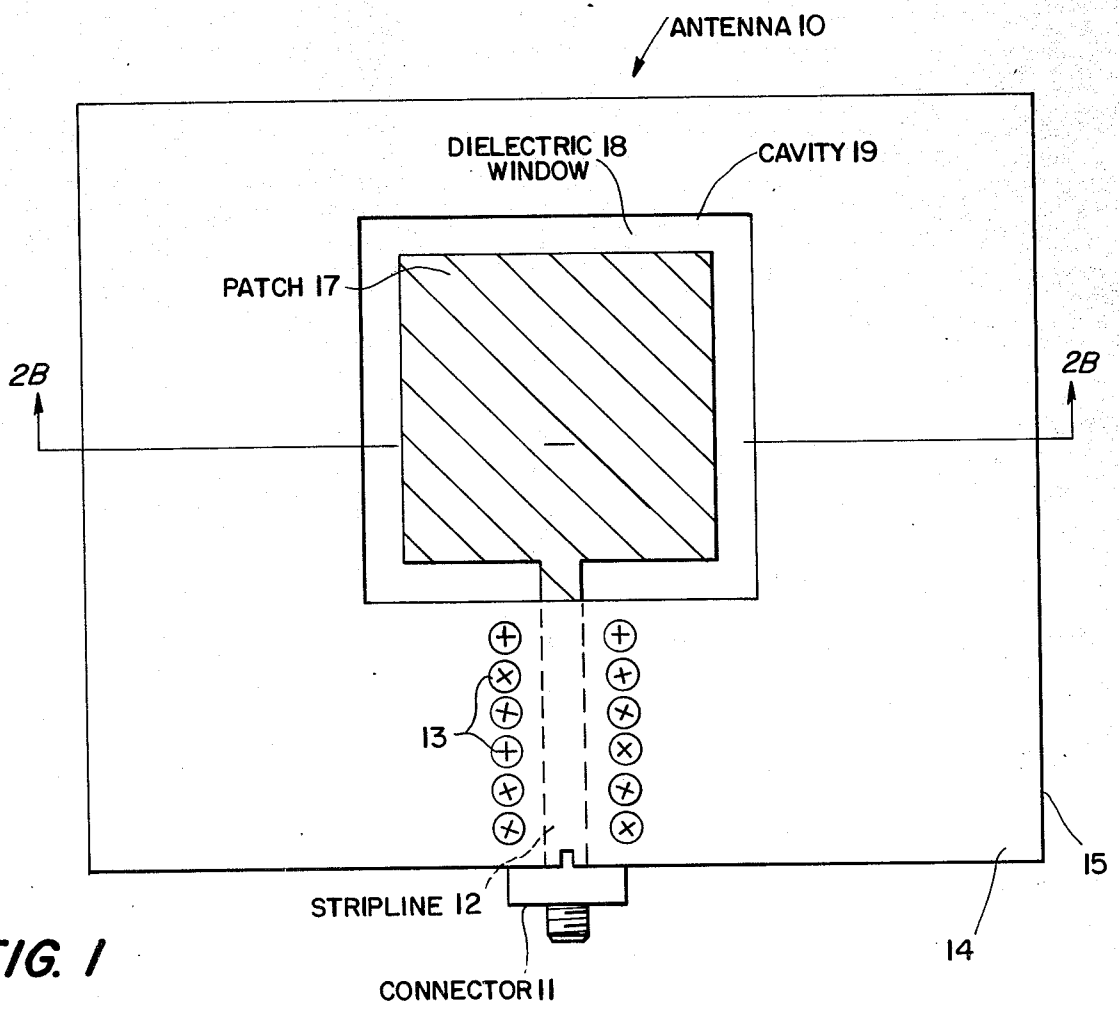
FIG. 1 is a top view of one embodiment made according to the present invention.
Figure 2A:
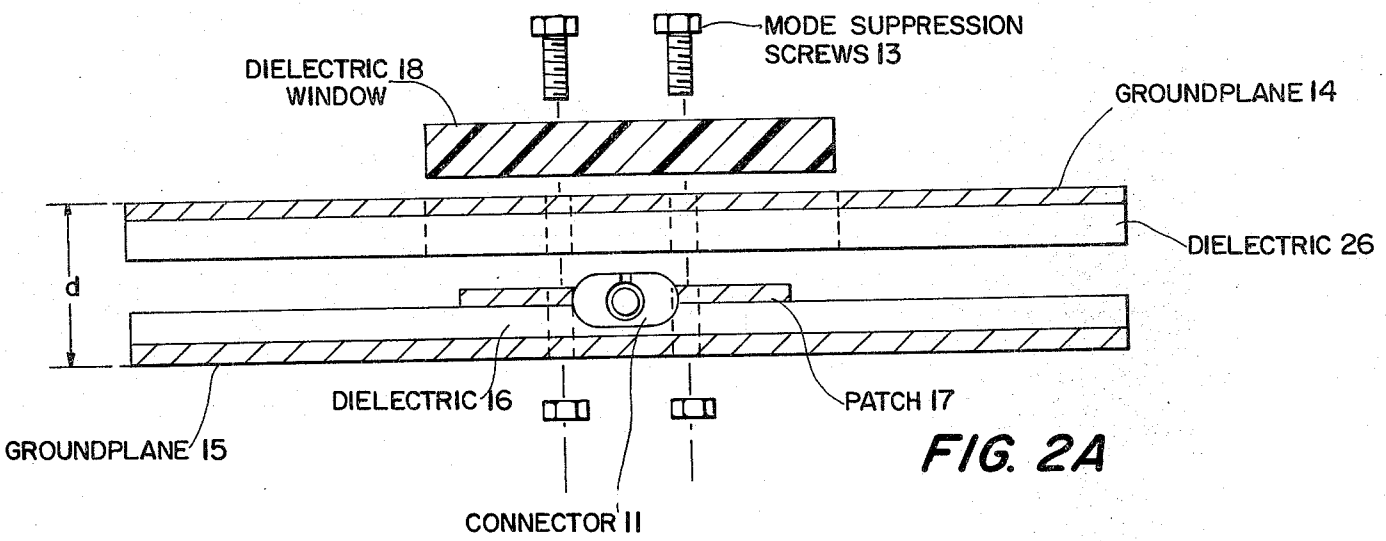
FIG. 2A is an exploded front view of the embodiment shown in FIG. 1.
Figure 2B:
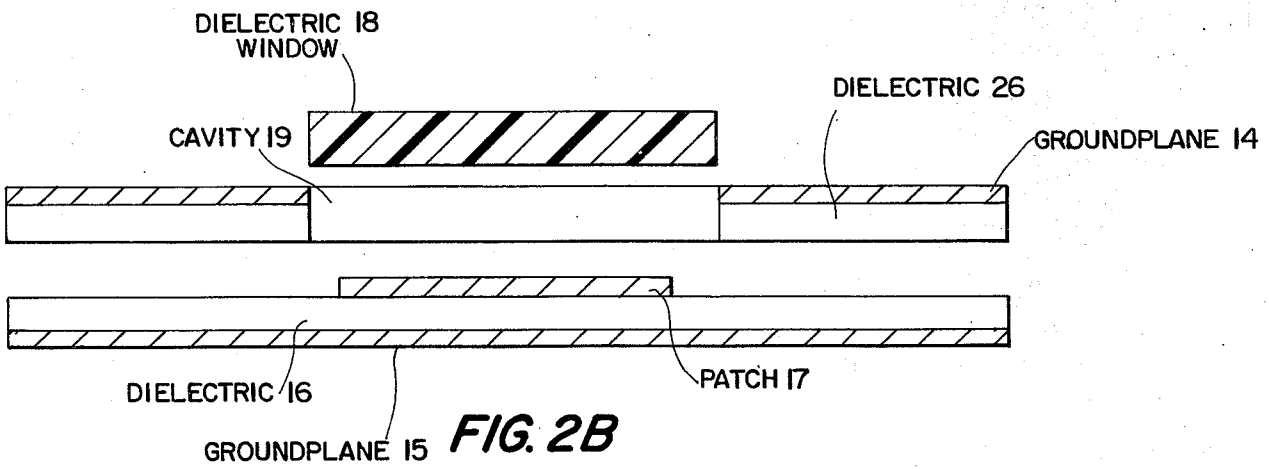
FIG. 2B is an exploded front view of the embodiment shown in FIG. 1, taken along line 2B.

Referring now to the drawings, and in particular to FIGS. 1, 2A and 2B, where there is shown respectively, a top, an exploded front view, and an exploded sectional view, of a stripline patch antenna 10. A nearly square microstrip patch radiator 17 is supported on a dielectric layer 16 surrounded by a square cavity in an adjacent dielectric layer 26; one surface of patch radiator 17 is coplanar with one surface of the layer 16. The dielectric layers 16, 26 and the patch radiator 17 are sandwiched between two parallel, electrically conducting groundplanes 14, 15. A nearly square cavity 19 also extends through the groundplane 14 adjoining the coplanar surface of layer 26 and is centered around patch radiator 17 to form an aperture. Cavity 19 is larger in area than patch radiator 17. A window 18 of a dielectric material completely fills cavity 19. A coaxial external connector 11 of conventional design is mounted along one of the sides of antenna 10 formed by the edge of groundplanes 14, 15 and dielectric layer 16. A stripline 12, preferably having a length equal to one quarter of the carrier frequency wavelength, is also embedded in the coplanar surface of dielectric layer 16, and electrically couples the external connector 11 with the patch radiator 17. Mode suppression screws 13 extend through dielectric layers 16, 26 and between opposite ground planes 14, 15 to form opposite rows along, and parallel with, the length of stripline 12. These screws 13 maintain an equipotential between groundplanes 14, 15 and prevent spurious modes from being induced into dielectric layers 16, 26. When connector 11 is coupled to a radio frequency generator, energy travels along stripline 12 to patch 17, and is radiated through dielectric window 18 into the surrounding environment, typically the atmosphere.

It is apparent from the details of this description that the disclosed structure provides an improved antenna. Since a dielectric window completely fills the cavity, there is no tuned slot, and changes in ambient temperature will not cause a change in the effective area of the patch radiator. Also, the stripline 12 (i.e., the "feedline") over which energy travels between patch radiator 17 and coaxial external connector 11 is shielded by ground planes 14, 15 and mode suppression eyelettes 13, thereby preventing the feedline from causing unpredictable variations in radiation patterns and impedance characteristics.

Although the stripline patch antenna is described as an antenna for radiating electromagnetic energy, it can also be used to receive electromagnetic energy. In either utility, several of the stripline patch antennae can be arranged and, with the ancillary switching and phase shifting circuitry, operated as a cylindrical array. The embodiment described may be made with two or more stripline feed elements 12, with each different in pathlength by one quarter of the wavelength of the carrier signal. Alternately, stripline 12 may serve as a quarter wavelength transformer between two phase shifting sections.

Several characteristics of the stripline patch antenna require consideration and the exercise of judgment by one endeavoring to practice the teachings set forth in the preceeding paragraphs of this description. For example, the dimensions of patch radiator 17 are determined by the value of the carrier frequency selected. In one embodiment, the length of patch radiator was empirically set at 0.49 of one wavelength of the carrier signal in the dielectric window, while the width (i.e., the dimension normal to the width), was empicirally set at less than 0.49 of the same wavelength. Patch radiator 17 may also have a circular perimeter, in which instance dielectric window 18 and cavity 19 will be annular. The dimensions of cavity 19 exceed those of patch 17 by one eighth of the dielectric wavelength of the carrier signal. The dielectric wavelength of the carrier signal is the quotient of the dielectric constant, $\epsilon_w$, for the window material, into the free space wavelength, $\lambda_c$, of the carrier signal. Typically window 18 is made of a dielectric material having a low coefficient of thermal expansion, such as teflon or fiberglass. Although more susceptible to thermal deformation, polyethylene may also be used. The width of stripline 12 is inversely proportional to its resistance, and is determined by the antenna impedance required.

The stripline patch antenna may be made either by using discrete groundplanes 14, 15 or by using as groundplanes the copper clad exposed sides of two dielectric circuit boards of the well known teflon-fiberglass or perhaps, Mylar, bonded together to produce a sealed module in the manner taught by U.S. Pat. No. 4,021,813. The thickness, d, between the outside surfaces of the groundplanes of the assembled antenna 10 is set at less than one eighth of the dielectric wavelength of the carrier signal in order to avoid monopole radiation. Stripline 12 and patch 17, in comparison to dielectric layers 16, 26, have negligible thickness. In the latter structure, aligned holes through the two circuit boards plated with solder could be used in lieu of the mode suppression screws 13 to prevent spurious modes from being induced in the circuit boards between the groundplanes.

What is claimed, and desired to be secured by Letters Patent of the United States is:

1. An antenna, comprising:

a plurality of electrically conducting plates;

at least one of the plates perforated by an opening having a closed outline defining an aperture area;

an electrically conducting member positioned between two of the plates, adjoining and centered upon the aperture area;

the conducting member having a surface area less than the aperture area;

at least one feed element spaced between the two plates and abuttingly coupled to the conducting member;

a plug of a dielectric material completely filing the aperture;

the plug having a perimeter everywhere contiguous to the closed outline;

insulating means electrically separating the conducting member and the feed element from the conducting plates; and means for attenuating radiation from the feed element.

2. The antenna set forth in claim 1, further comprising:

the means for attenuating radiation being a plurality of mode supression conductors formed in opposed rows spaced apart from the feed element and extending between the plates.

3. The antenna set forth in claim 1, further comprising:

the layer of dielectric material having one surface exposed to atmosphere in a plane parallel to the one of the plates.

4. The antenna set forth in claim 1, wherein:

the feed element conveys a carrier signal;

the electrically conducting plates have opposed major surfaces exposed to atmosphere; and the least distance between the opposed major surfaces is less than one eighth of the wavelength of the carrier signal in the dielectric material.

5. An antenna, comprising:

a plurality of electrically conducting plates;

at least one of the plates with an aperture having a closed outline;

an electrically conducting member positioned in a plane parallel to and between two of the plates and centered on the aperture;

the conducting member having an area less than the area of the aperture and a width less than the colinear dimension of the aperture;

at least one feed element spaced between the two plates in the plane with the conducting member and coupled to the conducting member at a junction within the closed outline;

the feed element having a least dimension in the plane less than the width of the conducting member;

a pane of a dielectric material having a perimeter coextensive with the closed outline, adjoining the conducting member and completely filling the aperture;

non-conducting means sandwiched between the conducting plates for electrically insulating the feed element from the conducting plates;

the non-conducting means insulating the conducting member from one of the plates opposite the aperture; and a plurality of electrically conducting pins extending between the plates and forming opposed rows spaced apart from the feed element.

6. The antenna set forth in claim 5, wherein the electrically conducting pins form two parallel rows.

7. The antenna set forth in claim 5, further comprising:

the dielectric window having one surface exposed to atmosphere in a plane parallel to the one of the plates.

8. The antenna set forth in claim 5 wherein:

the feed element conveys a carrier signal having a free-space wavelength $\lambda_c$;

the material has a dielectric constant of $\epsilon_w$; and the electrically conducting plates have opposed major surfaces exposed to a medium for propagation of the carrier signal; and the least distance between the opposed major surfaces is less than $\lambda_c/\epsilon_w$.

9. An antenna susceptible to electromagnetic energy in a medium for propagation, comprising:

at least one electrically conducting plate with at least one major surface exposed to the medium, provided with an opening having a closed outline;

an electrically conducting member of smaller dimensions than those of the opening with the same shape as the closed outline centered in a plane parallel to the conduction plate and adjoining the opening to form an aperture for support of a resonant mode of electromagnetic radiation having a wavelength $\lambda_c$;

at least one feed element spaced apart from the conducting plate, positioned in the plane relative to and coupled with the conducting member within the closed outline;

a window pane of a material having a dielectric constant $\epsilon_w$, and a coefficient of thermal expansion comparable to that of the conducting plate, with dimensions equal to those of the opening, having edges coextensive with the closed outline, disposed between the conducting member and the medium; and means for suppressing radiation of electromagnetic energy by the feed means.

10. The antenna set forth in claim 9, further comprising:

the feed element being symmetrically oriented with the electrically conducting member; and the means for suppressing radiation being a plurality of electrically conducting items equidistantly spaced in opposed relation apart from the feed element and shorted to the conducting plate.

11. The antenna set forth in claim 9, further comprising:

a second electrically conducting plate positioned in a plane parallel to the one conducting plate with the conducting member spaced in electrical insulation between the conducting plates and with the means for suppressing radiation shorted to both conducting plates;

the least distance between most distant parallel planes formed by the conducting plates being less than $\lambda_c/\epsilon_w$.

12. The antenna set forth in claim 9, further comprising:

a second feed element spaced apart from the conducting plate and the one feed element, positioned relative to and coupled with the conducting member.

13. The antenna set forth in claims 1, 5, or 11, further comprising the least distance between most distant parallel planes formed by the conducting plates being less than one-eighth of the wavelength in the dielectric material of a carrier signal to be propagated via the antenna.

14. The antenna set forth in claims 1 or 5, further comprising the dielectric material having a coefficient of thermal expansion lower in value than the coefficient of thermal expansion of the one of the electrically conducting plates with an aperture.

* * * * *